US007526940B2

(12) United States Patent
Van Essen

(10) Patent No.: US 7,526,940 B2
(45) Date of Patent: May 5, 2009

(54) DIE ELEMENT CHANGING DEVICES

(75) Inventor: Frederick Hubert Van Essen, Brighton (AU)

(73) Assignee: Betaswage Pty Ltd., Victoria (AU)

( * ) Notice: Subject to any disclaimer, the term of this patent is extended or adjusted under 35 U.S.C. 154(b) by 187 days.

(21) Appl. No.: 11/558,596

(22) Filed: Nov. 10, 2006

(65) Prior Publication Data

US 2008/0092621 A1 Apr. 24, 2008

(30) Foreign Application Priority Data

Oct. 20, 2006 (AU) ..... 2006230741

(51) Int. Cl.
*B21J 13/00* (2006.01)
*B21J 7/46* (2006.01)
*B21J 7/16* (2006.01)

(52) U.S. Cl. ..... 72/446; 72/402; 72/444

(58) Field of Classification Search ..... 72/76, 72/399, 434, 402, 444, 446, 448; 483/28, 483/29

See application file for complete search history.

(56) References Cited

U.S. PATENT DOCUMENTS 3,762,209 A * 10/1973 Herndon et al. ..... 72/402
4,703,643 A * 11/1987 Brooks et al. ..... 72/402
4,953,383 A * 9/1990 Stiver et al. ..... 72/446

* cited by examiner

*Primary Examiner*—Dana Ross
*Assistant Examiner*—Teresa Bonk
(74) *Attorney, Agent, or Firm*—Alston & Bird LLP

(57) ABSTRACT

The specification discloses a die element change tool for use with a crimp press having a plurality of die shoes positioned about a crimping work space, the die shoes being movable from a radial outer position to a radial inner position during a crimping process, the change tool being effective to remove a die element set or introduce a new die element set while the die shoes are in the radial outer position, the change tool having a main body part and a movable body part, the main body part having a number of circumferentially spaced operational positions each capable of retaining an individual die element held at one axial end by the movable body part and at the other axial end by the main body part, the change tool being bodily movable into the crimping work space to position each said die element carried thereby adjacent to a respective die shoe to be secured thereto, said movable body part being movable to disengage from said die elements such that the change tool can be withdrawn from the crimping work space with at least a portion of the change tool being moved between adjacent die elements held by said die shoes.

15 Claims, 5 Drawing Sheets

DIE ELEMENT CHANGING DEVICES

BACKGROUND OF THE INVENTION

1. Field of the Invention

The present invention relates to improvements in devices for changing die elements in crimp presses or the like, particularly as a complete set of die elements for the press rather than as individual die elements.

2. Description of Related Art

In the field of fluid connectors and in particular, hose assemblies, the preferred method of attaching a metal coupling onto a flexible or resilient hose is by crimping or swaging. This process involves permanently reducing, by application of mechanical forces, the radial dimensions of the outer sleeve of the coupling assembly and sandwiching the hose between the outer sleeve and an inner support tube. This provides both a fluid and mechanical connection of the coupling onto the flexible hose. Machines that achieve the foregoing are typically called a "crimp press" or a "swage press". As the forces required to crimp the outer collars of the hose coupling (ferrule) are very large, hydraulic actuation forces are normally used in these machines. In hydraulically actuated crimp presses a series of die shoes are disposed circumferentially about a work space where the crimping process is to occur, the die shoes are moved radially inwardly (or outwardly) by axial movement of an annular piston with ramp surfaces engaging radially outer surfaces of the die shoes. Movement of the annular piston is achieved by applied hydraulic fluid pressure. To the radial inner surfaces of the die shoes, a respective die element is releasably connected having a radially inner work engaging surface that presses against a ferrule or similar during a crimping process. Often a crimping process may take place in stages whereby progressively varying sized sets of die elements are attached to the die shoes to carry out a complete crimping process. Of course crimping different couplings and coupling sizes also requires the use of different sized and shaped die elements. The die elements may have differing radial dimensions and differing axial lengths. Generally a crimping machine will have one die element for each die shoe, however the number of die shoes can vary from machine to machine. It is, however a relatively common practice to have eight uniformly circumferentially spaced die shoes in a typical crimping press, and thus to change eight die elements each time a differing crimping effect is required can be time consuming, particularly if they are changed individually, ie one at a time.

Current existing methods of changing die elements within a crimp press generally fall into two types. A first method employs headed pins threaded into the radially outer surfaces of the die elements. A second method employs a dovetail arrangement where the dies slide through machined channels within the die shoes. In order to change a die element set with some kind of tool, most tool designs employ a magnet in combination with some sort of interlocking arrangement to "grab" the die element set (ie multiple die elements) and remove or install same into the crimp head of the crimp press. These tools require the magnet as they have not been able to attach themselves to both sides of the die elements for the following reasons. Firstly the die elements vary in length for different crimp diameters. Secondly, in a given die element set range for a given machine, the outside diameter will be constant but the inside diameter will vary. There is usually no method of attaching to the radially outer side of the die element set because it will be attached or engaged against the die shoes. Most arrangements of tools remove/install the die element set in the fully collapsed (or closed) position.

It is believed most existing systems require the die shoes to move radially inwardly to the radially inner closed or collapsed position to allow the die elements to be attached to the removal tool and thereafter the die shoes are moved outwardly to separate the die elements from the die shoes. The die shoes may thereafter be moved from the crimp head of the crimp press. Thus multiple die shoe radial movements inwardly and outwardly are required each time a set of die elements is to be changed.

To connect a new set of die elements to the die shoes, the tool carrying the die elements is positioned in the work space and the die shoes are again moved inwardly to connect with the new die elements carried by the tool. The die shoes, once the die elements are connected thereto are then moved radially outwardly to separate the die elements from the tool, and in the outer position, after the change tool has been removed and a work piece placed into the work space, the die shoes are moved inwardly to carry out a further crimping process stage. As will be apparent from the foregoing, to illustrate a die element or die element set change, four separate operations must be performed. As these machines function relatively slowly due to safety issues as well as their powerful nature, the total operation may not be much quicker than changing the die elements individually or one at a time.

The objective of the present invention is to provide a tool for changing a die element set in a crimp press or similar in a simpler, quicker and more convenient fashion.

BRIEF SUMMARY OF THE INVENTION

According to the present invention there is provided a die element change tool for use with a crimp press having a plurality of circumferentially located die shoes positioned about a crimping work space, said die shoes being movable from a radial outer position to a radial inner position during a crimping process, said change tool having a main body part and a movable body part, said movable body part being movable at least in part rotatably about a first axis and also in part in the direction of said first axis, said main body part having a plurality of circumferentially spaced operational positions each adapted to locate a die element, each said operational position on said main body part including a first retainer means cooperable with one axial end zone of a said die element to prevent movement of the one axial end zone of the die element in a radial direction, said movable body part including a plurality of radially extending arms having second retainer means at or adjacent an outer end region of said arms, each said second retainer means being cooperable with a second axial end zone, opposed to said first axial end zone, of the die element in a radial direction, whereby, in a first position of said movable body part relative to said main body part, a said die element positioned parallel to said first axis is located and held in each said operational position between a said arm and the main body part, said movable body part being axially movable from said first position to free the die elements from the change tool and rotatable to disengage said arms from said die elements. In the preceding paragraph and hereafter "crimp" and "crimping" are intended to also convey "swage" and "swaging" or any similar processes and machinery embodying such processes.

Conveniently, the die elements are secured to or removed from the die shoes only when said die shoes are in a said radial outer position, the change tool being removed from the crimping work space after connecting the die elements carried thereby with a said die shoe by moving at least the radial outer end region of said arms through a circumferential space between the die elements secured to the die shoes.

In preferred embodiments described herein, the movable body part is urged by spring means to move towards said first position and being movable against said spring means axially away from said first position. The die element change tool may further include divider means formed on said main body part between each said operational position, said divider means defining a space therebetween to receive a said die element generally therein.

Preferably detent means is provided operable between said movable body part and said main body part to restrict relative rotational movement between defined first and second limits, the first limit being where each said radial arm engages a said die element and the second limit being where each said radial arm is positioned circumferentially between two adjacent said die elements without engaging either of the die elements.

In one preferred arrangement the first retainer means includes a first projecting formation on the main body part or on the one axial end zone of a said die element, being cooperably engageable with a recessed formation on the other of said one axial end zone of a said die element or the main body part. The second retainer means may include a projecting ridge formation having an axially extending dimension and configured as part of a circle with its radius centred on the first axis, said ridge being received in a cooperating groove formed on the second axial end zone of a said die element. As a possible alternative, the second retainer means includes a groove formation having an axially extending dimension and configured as part of a circle with its radius centred on the first axis, a projecting formation on the second axial end zone of a said die element being receivable in said groove.

The die element change tool as disclosed herein can operationally enter the crimping work space of the crimp press from either a forward or a rear side of the crimping work space.

In accordance with another aspect, the present invention also provides a crimp press having a plurality of circumferentially located die shoes positioned about a crimping work space, each said die shoe having a pair of side press plates urged generally towards the sides of the die shoe by spring means and being angled towards one another with radially inner edges projecting inwardly from an inner surface of the die shoe, each said inner edge of the side press plates engaging in a groove formed in at least part of a rear wall surface of the element so as to radially hold said die element to said die shoe, and detent means operable between said die element and said die shoe to axially locate said die element relative to said die shoe.

In yet another aspect, the present invention also provides a crimp press having a plurality of circumferentially located die shoes positioned about a crimping work space, each said die shoe having a pair of side press plates urged generally towards the sides of the die shoe by spring means and being angled towards one another with radially inner edges projecting inwardly from an inner surface of the die shoe, each said inner edge of the side press plates engaging in a groove formed in at least part of a rear wall surface of the element so as to radially hold said die element to said die shoe, and detent means operable between said die element and said die shoe to axially locate said die element relative to said die shoe, and a die element change tool for use with the aforesaid crimp press, said change tool having a main body part and a movable body part, said movable body part being movable at least in part rotatably about a first axis and also in part in the direction of said first axis, said main body part having a plurality of circumferentially spaced operational positions each adapted to locate a die element, each said operational position on said main body part including a first retainer means cooperable with one axial end zone of a said die element to prevent movement of the one axial end zone of the die element in a radial direction, said movable body part including a plurality of radially extending arms having second retainer means at or adjacent an outer end region of said arms, each said second retainer means being cooperable with a second axial end zone, opposed to said first axial end zone, of the die element in a radial direction, whereby, in a first position of said movable body part relative to said main body part, a said die element positioned parallel to said first axis is located and held in each said operational position between a said arm and the main body part, said movable body part being axially movable from said first position to free the die elements from the change tool and rotatable to disengage said arms from said die elements.

Preferably the inner edge of the press plates has at least one abutment formed therein, the grooves in said die elements extending only partially along the axial length of the die elements whereby axial ends of said grooves abut a respective said abutment in said inner edges of the press plates. The inner edge of the press plates may have two spaced said abutments whereby the axial ends of the grooves engage one of said abutments depending upon whether the die enters the work space from a front or a rear zone of the crimp press.

In accordance with yet another aspect of this invention, there is provided a die element change tool for use with a crimp press having a plurality of die shoes positioned about a crimping work space, the die shoes being movable from a radial outer position to a radial inner position during a crimping process stage, the change tool being adapted to remove or install die element sets to said die shoes when the die shoes are in said radial outer position, the change tool having a main body part and a movable body part, the main body part having a plurality of circumferentially spaced operational positions each adapted to retain a die element held separately by said movable body part and said main body part, the change tool being bodily movable carrying a die element set into said crimping work space to position each said die element carried thereby adjacent to a respective said die shoe of the crimp press to be held to said die shoe, the movable body part being movable to disengage from said die elements such that the change tool without said die elements can be withdrawn from the crimping work space with at least a portion of the change tool being moved between adjacent die elements held by said die shoes. Conveniently the movable body part holds said die elements at one axial end thereof and the main body part holds said die elements at the other axial end of said die element. Preferably spring means is provided to urge said movable part towards said main body part, the die elements being held between said body parts at least partially by forces applied by said spring means.

BRIEF DESCRIPTION OF THE DRAWINGS

The drawings annexed hereto illustrate by way of example only, one preferred embodiment of the present invention. In the drawings.

DETAILED DESCRIPTION OF THE INVENTION

Figure 1:
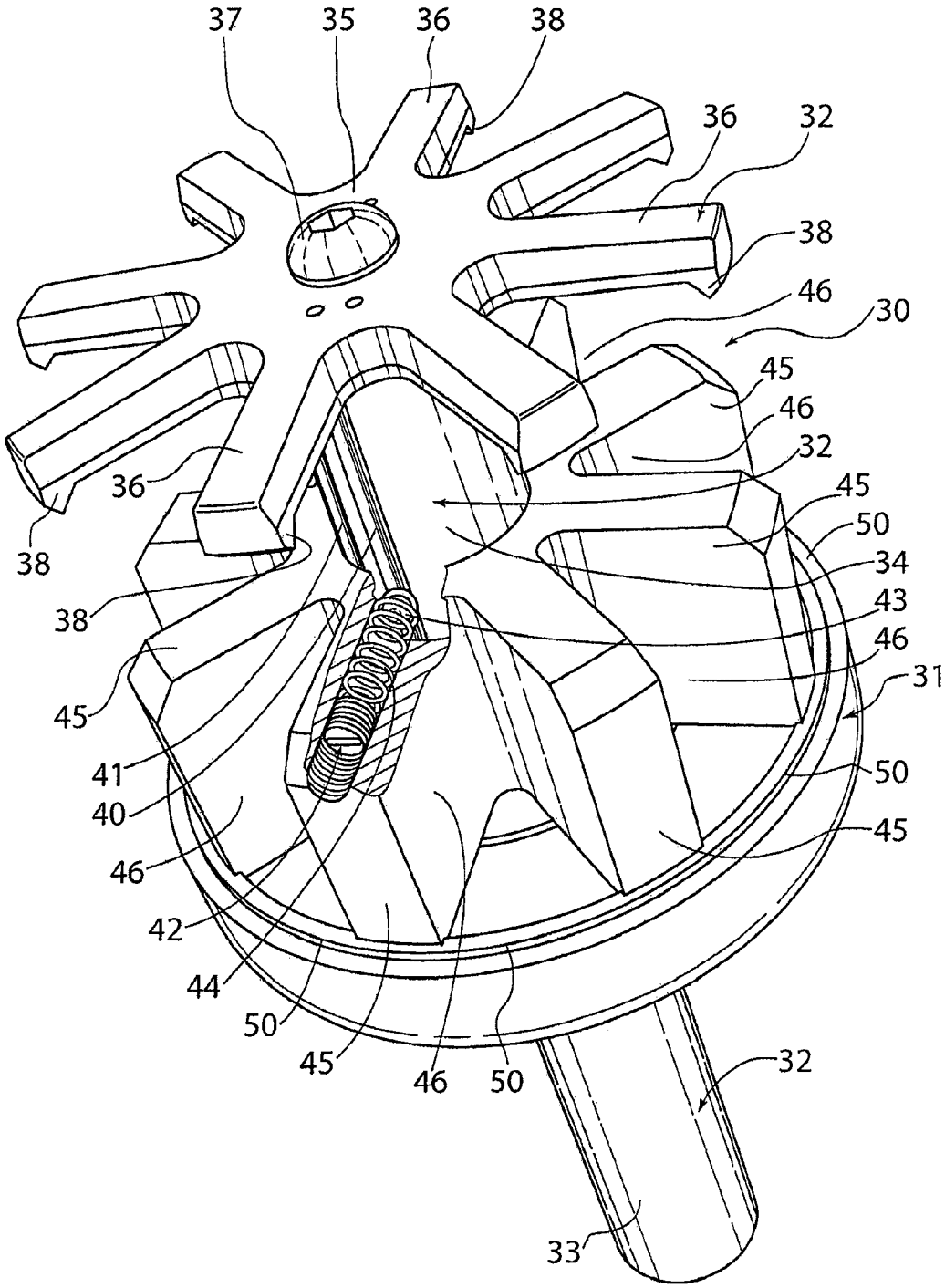
FIG. 1 is a perspective view of a preferred embodiment of die element change tool in a first configuration.
Figure 2:
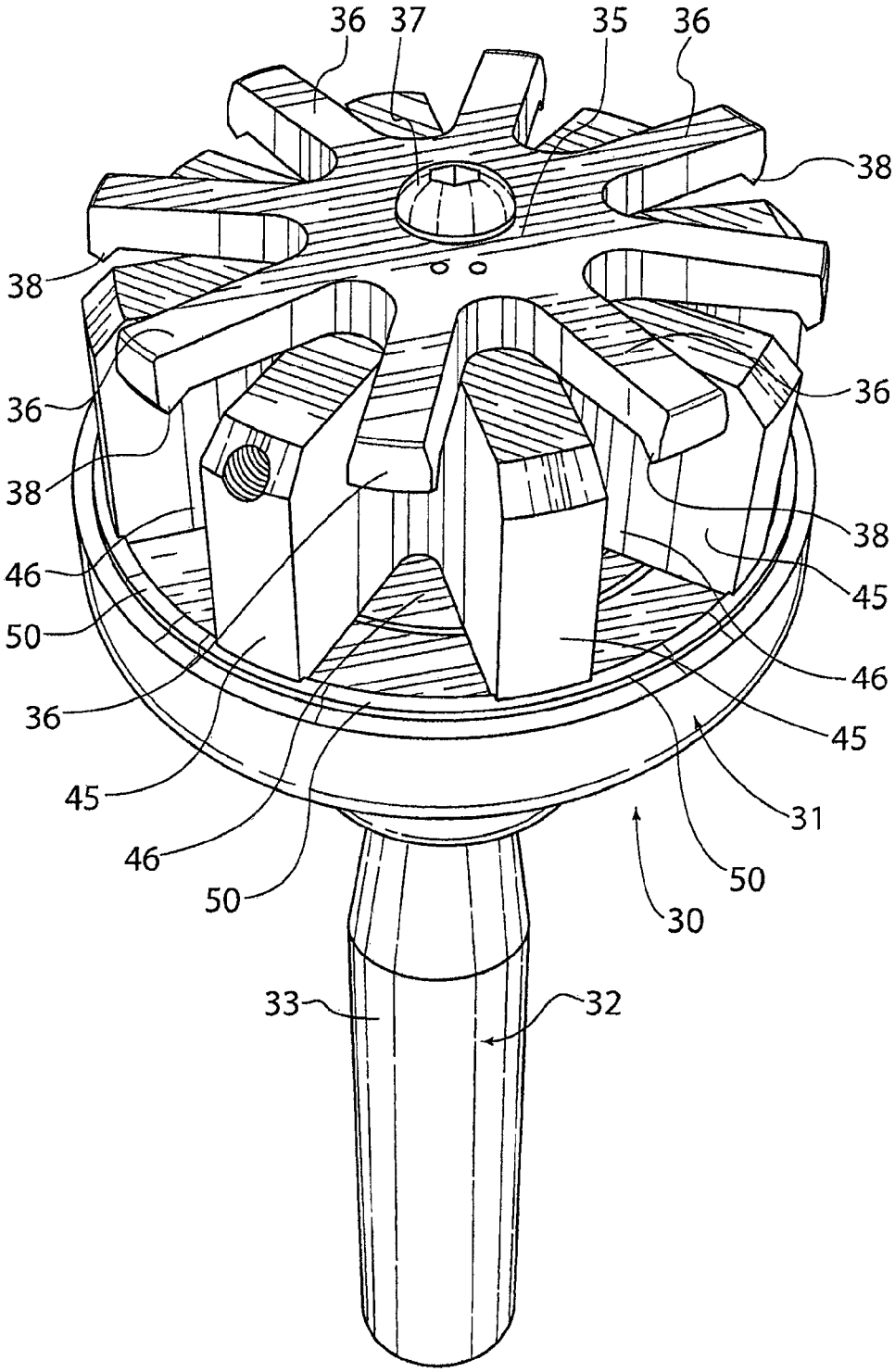
FIG. 2 is a perspective view similar to FIG. 1 showing the change tool of FIG. 1 in a second configuration.
Figure 3:
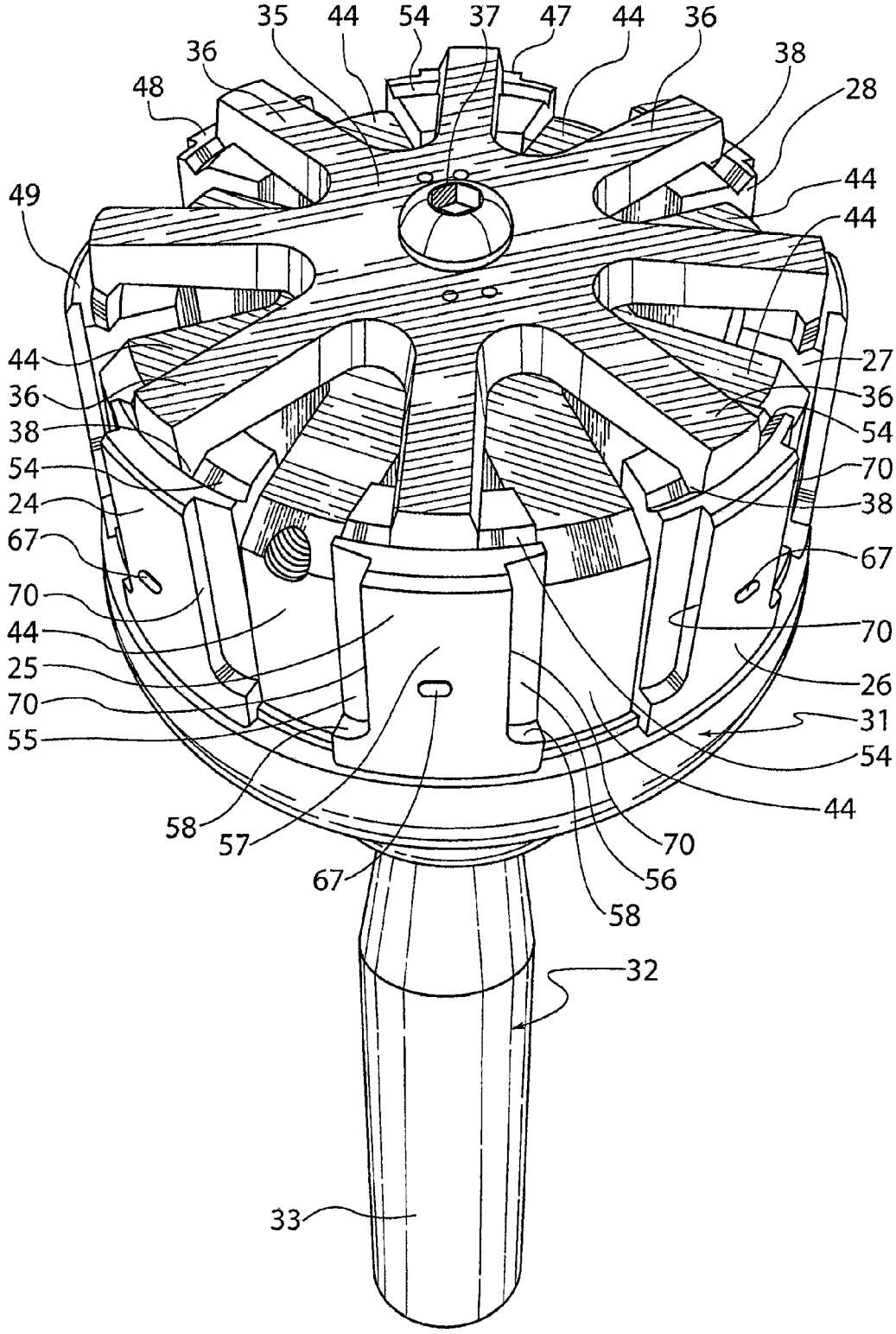
FIG. 3 is a perspective view similar to FIG. 1 but showing the change tool holding a set of die elements.
Figure 4:
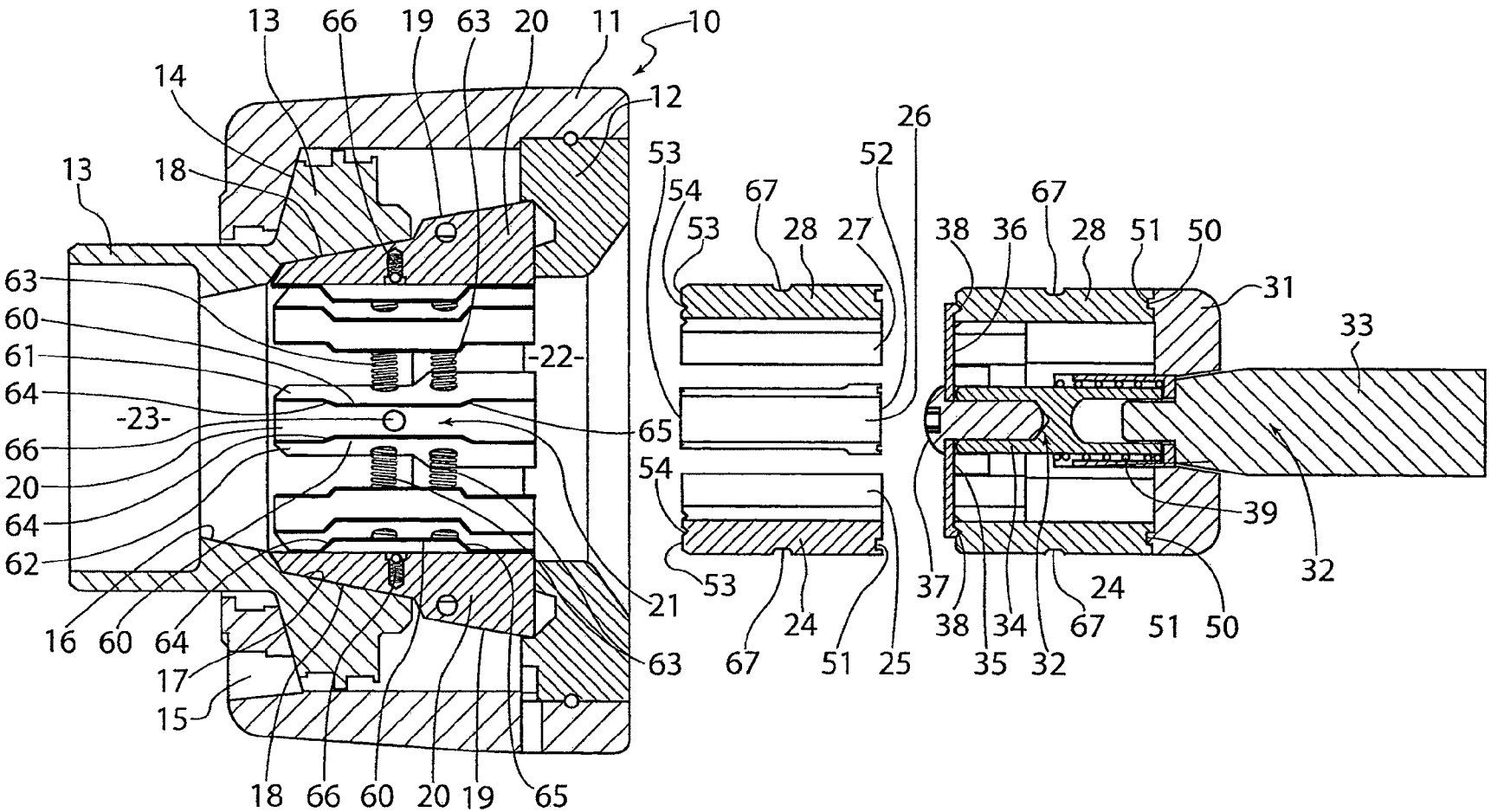
FIG. 4 is a cross-sectional view of a crimp press, a set of die elements, and a change tool holding a set of die elements ready to be introduced into the crimp press.
Figure 5:
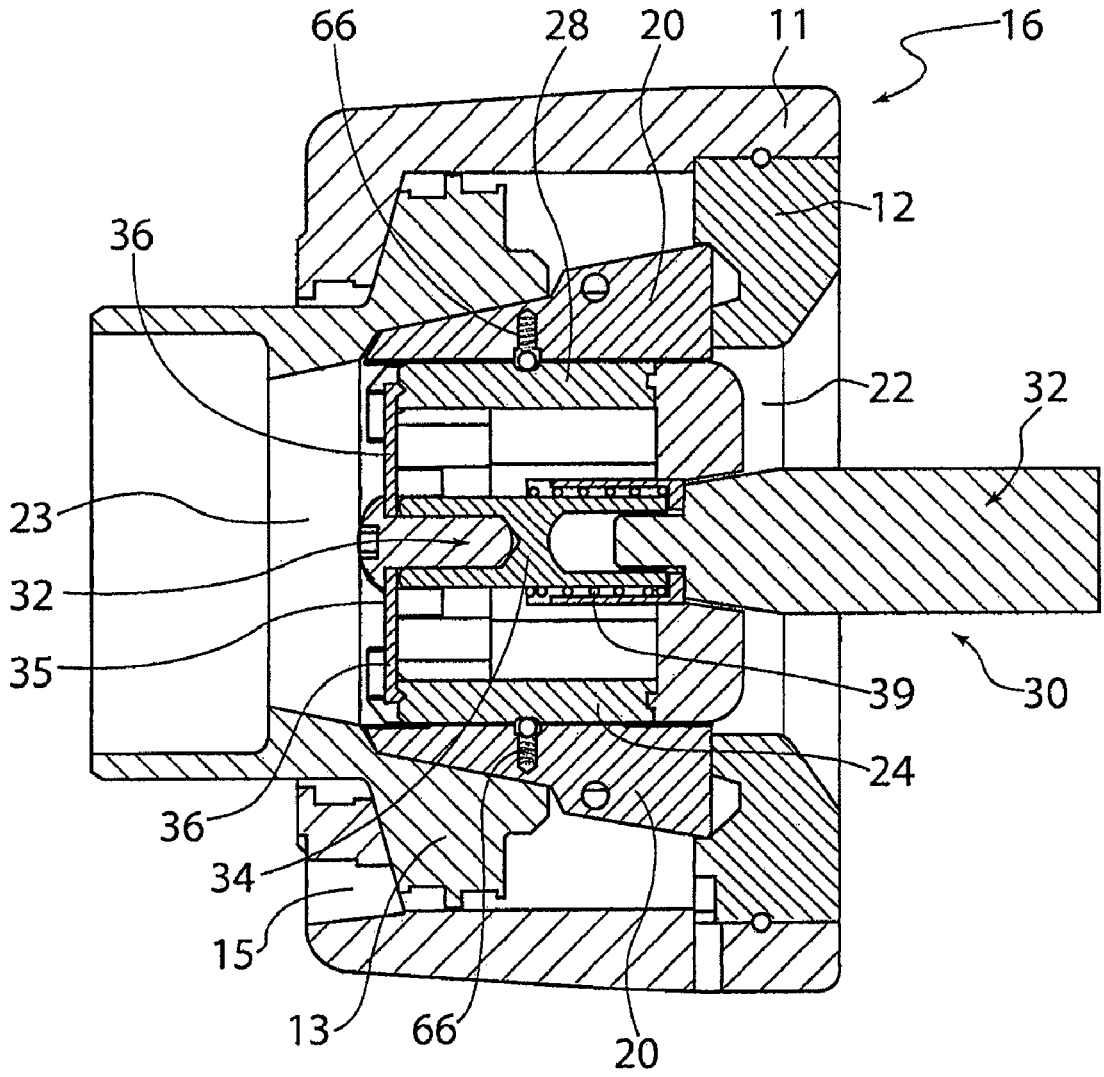
FIG. 5 is a cross-sectional view of the crimp press of FIG. 4 with the die element change tool operationally positioned in the work space of the crimp press.

Referring first to FIGS. 4 and 5, a crimp press 10 is illustrated schematically having an outer housing 11 and a front plate 12. An annular piston member 13 is located within the housing 11 such that it can move from the rear position illustrated towards the front plate 12 under action of hydraulic pressure fluid applied to the rear annular face 14 of the piston member 13 through a port 15. The piston member 13 has inwardly facing ramp surfaces 16, 17 that engage with radially outwardly facing ramp surfaces 18, 19 in die shoes 20 operationally positioned within the housing 11. The axial movement of the annular piston member 13 with the resultant engagement of the ramp surfaces 16, 17 on surfaces 18, 19 cause the die shoes to move inwardly from the outer most illustrated position during a crimping operation. Access to a crimping work zone 21 within the crimp press 10 is either through the front opening 22 in the front plate 12 or through the rear opening 23 in the piston member 13. In FIG. 4, five of eight die shoes 20 are shown essentially in their outer most radial position. Also five of eight die elements 24, 25, 26, 27 and 28 are illustrated ready to be introduced into engagement with the die shoes 20. Although it is relatively common to have eight die element sets, it is of course possible to have other numbers of die shoes and cooperating die elements. The die element change tool 30 is illustrated in FIGS. 1 to 3 and shown in cross-section in FIGS. 4 and 5. The change tool 30 includes a main body part 31 and a movable body part 32 including a gripping handle 33. The handle 33 is secured to a shaft 34 passing through the main body part 31 and has at its outer end, a plate 35 with evenly spaced arms 36 extending laterally from the shaft 34 secured to the shaft 34 by a threaded fastener 37. Positioned at the outer ends of the arms 36 are wedge shaped projections 38 facing towards the main body part 31.

As is best seen in FIGS. 4, 5 a spring element 39 is provided urging the handle 33 and shaft 34 to the right in FIGS. 4, 5 such that the plate 35 is urged towards the main body part 31. The spring element 39 has a relatively strong spring rating such that the urging force is relatively high but not so high as to prevent an intended user from manually moving the plate 35 against the applied spring forces. FIG. 1 shows the shaft 34 with a pair of axially directed grooves 40, 41 spaced apart and adapted to receive a detent mechanism 42 including a detent ball 43 urged by a detent spring 44, the detent mechanism 42 being mounted in the main body part 31. This arrangement allows the shaft 34 to be moved axially by the spring element 39 or against the spring element 39 without relative rotation between the movable body part 32 and the main body part 31, however when desired the shaft 34 and thereby the plate 35 can be rotated between angular positions defined by the axial grooves 40, 41 for reasons described below.

As can be seen in FIGS. 1 to 3, the main body part 31 includes eight radially extending dividing walls 45, one of which mounts the detent mechanism 42. The spaces 46 between the dividing walls 44 are intended to locate die elements 24, 25, 26, 27, 28, 47, 48 and 49 therebetween. Each of the spaces 46 has a circular "square" formed ridge 50 generally around a radially outer zone, the ridge 50 being adapted to fit in a complementary shaped groove 51 in one axial end 52 of the die elements 24 to 28 and 47, 48 and 49. At a second or other end 53 of the die elements, a V shaped groove 54 is provided which engages with the wedge shaped projections 38 on the arms 36. Thus, as shown in FIG. 3, the required number of die elements can be held between the arms 36 and the main body part 31 of the change tool 10.

FIG. 3 also best illustrates the grooves 55, 56 formed on either side of the rear or outer face 57 of the die elements, the grooves extending part way along the axial length of the rear faces 57 and ending in an abutment 58. The grooves 55, 56 also have undercut surfaces 59 intended to engage with the central elevated parts 60 of press plates 61, 62 located on either side of the die shoes 20 (see FIG. 4). The press plates 61, 62 are pressed by spring elements 63 to engage and hold undercut surfaces 70 of the die elements and thereby hold the die elements themselves to the die shoes 20 when appropriately positioned. Axial positioning and holding of the die elements relative to the die shoes 20 is achieved by abutment 58 of the grooves 55, 56 engaging with an abutment 64, 65 on the press plates 60, 61 at either end of the elevated part 59. At this position, a ball detent mechanism 66 in the die shoe engages with a recess 67 in the rear faces 57 of the die elements.

As shown in the right of FIG. 4, a change tool 30 loaded with die elements 24 to 28 and 47 to 49 inserted into the working space 21 of the crimp press 10 positions the rear face grooves 55, 56 between the press plates 60, 61 until properly positioned by the abutments engaging and the detent mechanism 66 and recess 67 engaging. It will of course be appreciated that this can be achieved by entering the space 21 either through the forward opening 22 or the rearward opening 23. At this point (FIG. 5), the plate 35 and radial arms 36 are axially moved relative to the main body 31 to disengage the arms 36 from the die elements and the shaft 34 is rotated to its second position where the arms 36 and the dividing walls 44 are aligned. In this configuration the change tool 30 can simply be withdrawn from the position shown in FIG. 5 with the arms 36 and walls 44 passing between the die elements 24 to 28/47 to 49. To remove the inserted die elements, the process is reversed. Thereafter a new die element set can be readily introduced operationally into the crimp press 10. These operations are all done with the crimp pres positioned with the die shoes in the outer most position and in this position, when a desired set of die elements has been installed, the crimp press is ready for a crimping action to take place. Thus in and out movements of the die shoes are minimised and the die elements are quickly and easily interchanged with minimal time delay between crimping operations.

It will of course be appreciated that various changes or modifications can be made within the scope of the annexed claims. While the above description discloses an essentially mechanical structure for holding the die elements to the die shoes, it is of course possible to use magnetics, at least partially to achieve this connection between the die element and the die shoes.

The invention claimed is:

1. A die element change tool for use with a crimp press having a plurality of circumferentially located die shoes positioned about a crimping work space, said die shoes being movable from a radial outer position to a radial inner position during a crimping process, said change tool having a main body part and a movable body part, said movable body part being movable at least in part rotatably about a first axis and also in part in the direction of said first axis, said main body part having a plurality of circumferentially spaced operational positions each adapted to locate a die element, each said operational position on said main body part including a first retainer means cooperable with one axial end zone of a said die element to prevent movement of the one axial end zone of the die element in a radial direction, said movable body part including a plurality of radially extending arms having second retainer means at or adjacent an outer end region of said arms, each said second retainer means being cooperable with a second axial end zone, opposed to said first axial end zone, of the die element in a radial direction, whereby, in a first position of said movable body part relative to said main body part, a said die element positioned parallel to said first axis is located and held in each said operational position between a said arm and the main body part, said movable body part being axially movable from said first position to free the die elements from the change tool and rotatable to disengage said arms from said die elements.

2. A die element change tool according to claim 1, wherein said die elements are secured to or removed from said die shoes only when said die shoes are in a said radial outer position, the change tool being removed from the crimping work space after connecting the die elements carried thereby with a said die shoe by moving at least the radial outer end region of said arms through a circumferential space between the die elements secured to the die shoes.

3. A die element change tool according to claim 1, wherein the movable body part is urged by spring means to move towards said first position and being movable against said spring means axially away from said first position.

4. A die element change tool according to claim 3, further including divider means formed on said main body part between each said operational position, said divider means defining a space therebetween to receive a said die element generally therein.

5. A die element change tool according to claim 1, wherein detent means is provided operable between said movable body part and said main body part to restrict relative rotational movement between defined first and second limits, the first limit being where each said radial arm engages a said die element and the second limit being where each said radial arm is positioned circumferentially between two adjacent said die elements without engaging either of the die elements.

6. A die element change tool according to claim 1, wherein the first retainer means includes a first projecting formation on the main body part or on the one axial end zone of a said die element, being cooperably engageable with a recessed formation on the other of said one axial end zone of a said die element or the main body part.

7. A die element change tool according to claim 1, wherein the second retainer means includes a projecting ridge formation having an axially extending dimension and configured as part of a circle with its radius centred on the first axis, said ridge being received in a cooperating groove formed on the second axial end zone of a said die element.

8. A die element change tool according to claim 1, wherein the second retainer means includes a groove formation having an axially extending dimension and configured as part of a circle with its radius centred on the first axis, a projecting formation on the second axial end zone of a said die element being receivable in said groove.

9. A die element change tool according to claim 1, wherein the change tool can enter the crimping work space of the crimp press from either a forward or a rear side of the crimping work space.

10. A crimp press having a plurality of circumferentially located die shoes positioned about a crimping work space, each said die shoe having a pair of side press plates urged generally towards the sides of the die shoe by spring means and being angled towards one another with radially inner edges projecting inwardly from an inner surface of the die shoe, each said inner edge of the side press plates engaging in a groove formed in at least part of a rear wall surface of the element so as to radially hold said die element to said die shoe, and detent means operable between said die element and said die shoe to axially locate said die element relative to said die shoe, and a die element change tool for use with the aforesaid crimp press, said change tool having a main body part and a movable body part, said movable body part being movable at least in part rotatably about a first axis and also in part in the direction of said first axis, said main body part having a plurality of circumferentially spaced operational positions each adapted to locate a die element, each said operational position on said main body part including a first retainer means cooperable with one axial end zone of a said die element to prevent movement of the one axial end zone of the die element in a radial direction, said movable body part including a plurality of radially extending arms having second retainer means at or adjacent an outer end region of said arms, each said second retainer means being cooperable with a second axial end zone, opposed to said first axial end zone, of the die element in a radial direction, whereby, in a first position of said movable body part relative to said main body part, a said die element positioned parallel to said first axis is located and held in each said operational position between a said arm and the main body part, said movable body part being axially movable from said first position to free the die elements from the change tool and rotatable to disengage said arms from said die elements.

11. A crimp press according to claim 10, wherein said inner edge of the press plates has at least one abutment formed therein, the grooves in said die elements extending only partially along the axial length of the die elements whereby axial ends of said grooves abut a respective said abutment in said inner edges of the press plates.

12. A crimp press according to claim 11, wherein said inner edge of the press plates has two spaced said abutments whereby the axial ends of the grooves engage one of said abutments depending upon whether the die enters the work space from a front or a rear zone of the crimp press.

13. A die element change tool for use with a crimp press having a plurality of die shoes positioned about a crimping work space, the die shoes being movable from a radial outer position to a radial inner position during a crimping process stage, the change tool being adapted to remove or install die element sets to said die shoes when the die shoes are in said radial outer position, the change tool having a main body part and a movable body part, the main body part having a plurality of circumferentially spaced operational positions each adapted to retain a die element held separately by said movable body part and said main body part, the change tool being bodily movable carrying a die element set into said crimping work space to position each said die element carried thereby adjacent to a respective said die shoe of the crimp press to be held to said die shoe, the movable body part being movable to disengage from said die elements such that the change tool without said die elements can be withdrawn from the crimping work space with at least a portion of the change tool being moved between adjacent die elements held by said die shoes.

14. A die element change tool according to claim 13, wherein the movable body part holds said die elements at one axial end thereof and the main body part holds said die elements at the other axial end of said die element.

15. A die element change tool according to claim 14, wherein spring means is provided to urge said movable part towards said main body part, the die elements being held between said body parts at least partially by forces applied by said spring means.

* * * * *